US007237865B2

(12) United States Patent
Hara

(10) Patent No.: US 7,237,865 B2
(45) Date of Patent: Jul. 3, 2007

(54) INKJET HEAD INSPECTION DEVICE

(75) Inventor: Kohzo Hara, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 307 days.

(21) Appl. No.: 11/063,326

(22) Filed: Feb. 22, 2005

(65) Prior Publication Data

US 2006/0066683 A1 Mar. 30, 2006

(30) Foreign Application Priority Data

Sep. 24, 2004 (JP) ..... 2004-278148

(51) Int. Cl.
*B41J 29/393* (2006.01)

(52) U.S. Cl. ..... 347/19

(58) Field of Classification Search ..... 347/19, 347/68–71

See application file for complete search history.

(56) References Cited

U.S. PATENT DOCUMENTS 4,435,634 A * 3/1984 Horlander ..... 347/209
6,123,415 A * 9/2000 Nagato et al. ..... 347/55
6,831,392 B2 * 12/2004 Nariai ..... 310/316.01
7,134,328 B2 * 11/2006 Komatsu et al. ..... 73/168

FOREIGN PATENT DOCUMENTS

| | | |
|---|---|---|
| JP | 11-64175 | 3/1999 |
| JP | 2000-318183 | 11/2000 |
| JP | 2000-355100 | 12/2000 |
| JP | 2004-9501 | 1/2004 |

* cited by examiner

*Primary Examiner*—Lamson Nguyen
(74) *Attorney, Agent, or Firm*—Fildes & Outland, P.C.

(57) ABSTRACT

An inkjet head inspection device inspects an inkjet head including plural nozzles that eject ink droplets, plural ink reservoirs that contain the ink to be ejected from the plural nozzles, and plural piezoelectric elements that exert pressure on the ink reservoirs to force the ink droplets out of the nozzles. The inkjet head inspection device has a differential amplifier section that amplifies a differential voltage between respective ground-side electrodes or opposite-side electrodes of the piezoelectric elements corresponding to two nozzles to be inspected, when a drive voltage application section applies a drive voltage to each of the piezoelectric elements, and a decision section that decides whether an ink jet malfunction occurs in the two nozzles to be inspected, based on the differential voltage furnished from the differential amplifier section.

5 Claims, 5 Drawing Sheets

INKJET HEAD INSPECTION DEVICE

BACKGROUND OF THE INVENTION

1. Field of the Invention

The present invention generally relates to an inkjet head inspection device and, in particular, to the inkjet head inspection device that inspects for ink jet malfunctions in an inkjet head.

2. Description of the Related Art

Diverse types of printer heads are used for printers; e.g., an inkjet head is known in which a piezoelectric element presses a pressure chamber to eject ink existing in the pressure chamber from a nozzle.

To eject ink droplets from the inkjet head, an external driving power supply applies an electric signal to an individual electrode and a common electrode, which distorts the piezoelectric element. The distortion of the piezoelectric element changes the volume of the pressure chamber via a vibrating plate and increases the pressure exerted on the ink filled in the pressure chamber. By this increased pressure, the ink is ejected from the nozzle as ink droplets.

The number of nozzles of an inkjet head tends to multiply as print media become larger and with faster printing. With the multiplication of the nozzles, the number of nozzles to experience an ink jet malfunction increases.

The ink jet malfunction takes place mainly because of piezoelectric element failure or air bubbles intruded into the pressure chamber, the bubbles impeding transmission of the displacement of the piezoelectric element to the pressure chamber. The piezoelectric element failure includes its electrical connection fault as well as its physical fault. When an ink cartridge is replaced, air is liable to enter an ink passage and the entered air stays as bubbles in the pressure chamber, which is liable to cause an inkjet malfunction of a nozzle.

Since lack of ink ejection degrades print quality, it is needed to detect ink jet malfunctions.

In Japanese Published Unexamined Patent Application No. Hei 11-64175, a technique for detecting ink jet malfunctions is described. In this technique, an impedance analyzer is connected to each piezoelectric element per nozzle to measure its proper frequency and a piezoelectric element that vibrates at a different frequency from the proper frequency in its normal contact state is judged to be a faulty contact.

In Japanese Published Unexamined Patent Application No. 2000-318183, a relevant technique is described. This technique acquires a profile of a piezoelectric element's resonance point and electrically detects the state of ink charged in a recording head in order to prevent air bubble intrusion into the ink passage, which is caused on account of insufficiently charged ink in the recording head.

In Japanese Published Unexamined Patent Application No. 2000-355100, a nozzle inspection technique is described. This technique applies a voltage with a predetermined frequency to a piezoelectric element, as an input for measurement, to inspect for an ink jet malfunction due to air bubble intrusion, a clogged nozzle, etc. Based on the thus input voltage and an output voltage measured on the piezoelectric element after being driven, a phase lag and the measured value of output voltage are compared with prepared reference data.

In Japanese Published Unexamined Patent Application No. 2004-9501, a technique for detecting a piezoelectric element failure occurring or air bubble intrusion into the pressure chamber is described. This technique measures a piezoelectric element's resonance frequency when being driven and compares the thus measured resonance frequency with a reference resonance frequency data to determine a change in the resonance frequency.

However, the technique described in Japanese Published Unexamined Patent Application No. Hei 11-64175 has a problem in which its implementation requires a very complex structure including impedance analyzers connected to each piezoelectric element per nozzle and a cost increase. To implement the techniques described in Japanese Published Unexamined Patent Application Nos. 2000-318183, 2000-355100 and 2004-9501, it is inevitable to perform complex processing, which poses a problem that restraining cost is impossible.

SUMMARY OF THE INVENTION

The present invention has been made to address the above-described problems and provides an inkjet head inspection device with a simple structure, capable of reliably inspecting an inkjet head for ink jet malfunctions.

To address the above problems and in accordance with the present invention, there is provided an inkjet head inspection device that inspects an inkjet head including plural nozzles that eject ink droplets, plural ink reservoirs that contain the ink to be ejected from the plural nozzles, and plural piezoelectric elements that exert pressure on the ink reservoirs to force the ink droplets out of the nozzles, the inkjet head inspection device including a differential amplifier section that amplifies a differential voltage between respective ground-side electrodes or opposite-side electrodes of the piezoelectric elements corresponding to two nozzles to be inspected, when a drive voltage application section applies a drive voltage to each of the piezoelectric elements and a decision section that decides whether an ink jet malfunction occurs in the two nozzles to be inspected, based on the differential voltage furnished from the differential amplifier section.

BRIEF DESCRIPTION OF THE DRAWINGS

Embodiments of the present invention will be described in detail based on the following figures, wherein.

DETAILED DESCRIPTION OF THE INVENTION

Embodiments of the present invention will be described hereinafter with reference to the drawings.

First Embodiment

Figure 1:
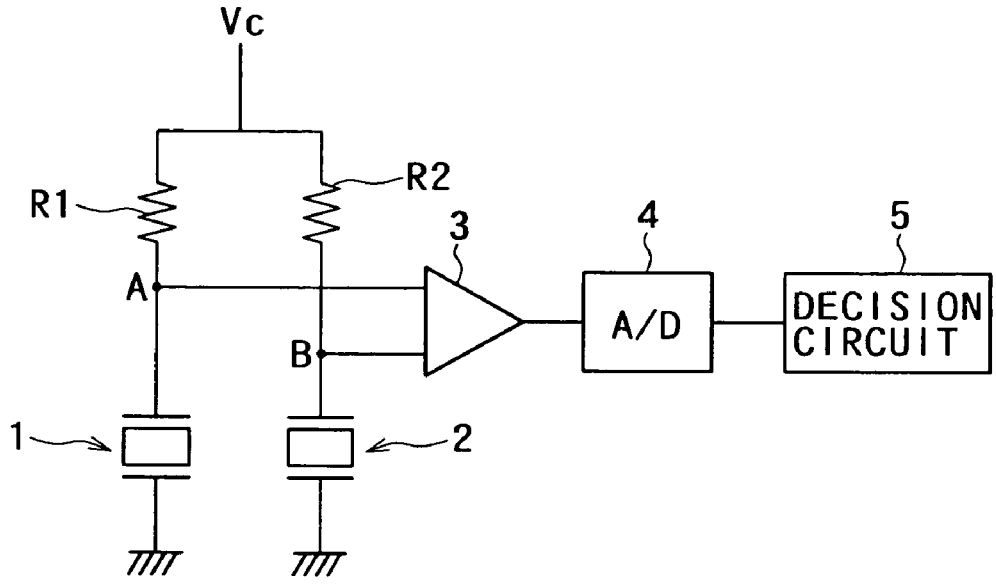
FIG. 1 shows a circuitry of an inkjet head inspection device according to an embodiment of the present invention.

FIG. 1 shows a circuitry of an inkjet head inspection device according to an embodiment of the present invention.

This inkjet head inspection device is equipped with piezoelectric elements 1, 2 provided corresponding to nozzles of an inkjet head of an inkjet printer, a differential amplifier circuit 3 which amplifies and outputs a differential voltage (>0) between respective electrodes of the piezoelectric elements 1 and 2, an A/D converter 4 which performs analog-to-digital conversion of the differential voltage, and a decision circuit 5 which decides whether an ink jet malfunction occurs in nozzles to be inspected, based on the differential voltage converted to a digital signal.

Although an inkjet head usually has a great number of piezoelectric elements, the description of the present embodiment is provided, taking up the two piezoelectric elements 1, 2 corresponding to the nozzles to be inspected as an example.

Figure 2:
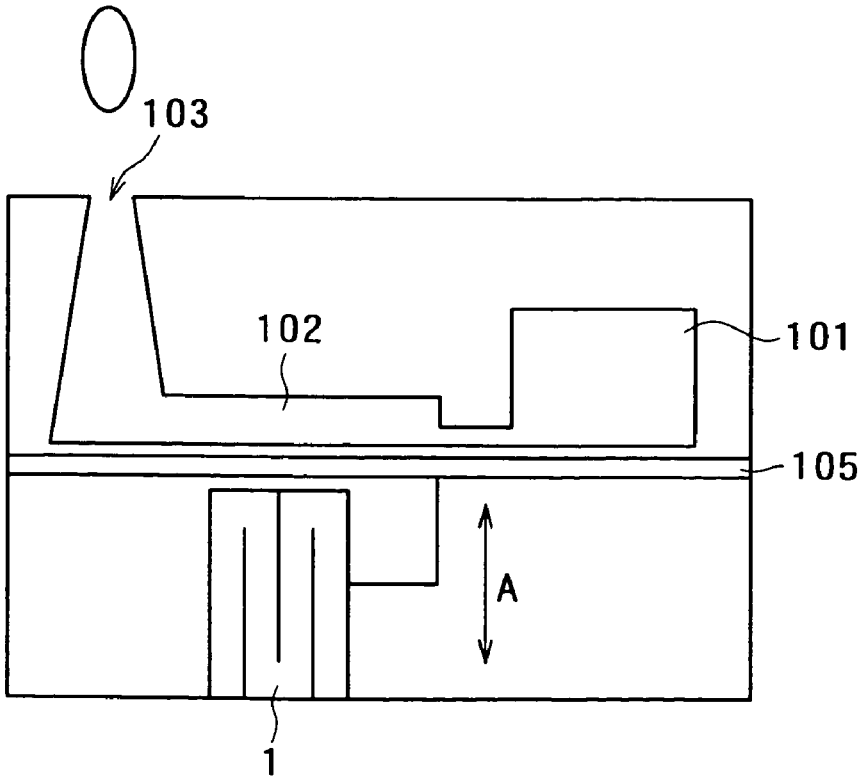
FIG. 2 is a schematic of simplified structure of an inkjet head.

FIG. 2 is a schematic of simplified structure of an inkjet head 100. Although the inkjet head 100 is configured to eject ink from plural nozzles, its fundamental structure will be described, using a nozzle corresponding to the piezoelectric element 1 as an example.

The inkjet head 100 includes an ink reservoir 101, an ink passage 102, a nozzle 103, a vibrating plate 105, the piezoelectric element 1 and the like. The ink reservoir 101 contains undiluted ink solution (to be ejected) 104 of any color of, e.g., cyan, magenta, and yellow. The ink reservoir 101 is connected through the ink passage (ink feed cavity) 102 to the nozzle 103.

Under the ink passage 102, the piezoelectric element 1 is located via the vibrating plate 105. The piezoelectric element 1 is displaced in the direction of arrow A when a drive voltage Vc is applied to it and exerts pressure on the ink reservoir 101 to eject ink 104 from the nozzle 103. Thus, if the piezoelectric element 1 becomes faulty, it becomes unable to vibrate the vibrating plate 105 and, in consequence, ink is not ejected from the nozzle 103.

As shown in FIG. 1, the piezoelectric element 1 is connected in series to a resistor R1 and the piezoelectric element 2 is connected in series to a resistor R2. These two series circuits are connected in parallel.

The drive voltage Vc generated by a driving power supply not shown is applied via the resistor R1 to one electrode of the piezoelectric element 1. The other electrode of the piezoelectric element 1 is grounded. The drive voltage Vc generated by the driving power supply is also applied via the resistor R2 to one electrode of the piezoelectric element 2. The other electrode of the piezoelectric element 2 is grounded.

The nozzles of the inkjet head 100 are formed equally in all details, the resistors R1 and R2 have the same resistance value, and the impedance characteristics of the piezoelectric elements 1 and 2 are identical values. Therefore, a combined impedance of the resistor R1 and the piezoelectric element 1 is equal to that of the resistor R2 and the piezoelectric element 2 and parallel circuits are formed.

One input terminal of the differential amplifier circuit 3 is connected to a point A where the resistor R1 and the piezoelectric element 1 are connected. The other input terminal of the differential amplifier circuit 3 is connected to a point B where the resistor R2 and the piezoelectric element 2 are connected.

Thus, the differential amplifier circuit 3 will output a differential voltage between the symmetric centers (equilibrium points) of a bridge circuit constituted by the resistor R1, piezoelectric element 1, piezoelectric element 2, and resistor R2. The output terminal of the differential amplifier circuit 3 is connected via the A/D converter 4 to the decision circuit 5.

In the inkjet head inspection device configured as above, when the drive voltage Vc is applied to the piezoelectric elements 1 and 2, the differential amplifier circuit 3 detects a differential voltage between the points A and B and supplies the differential voltage via the A/D converter 4 to the decision circuit 5.

The decision circuit 5 decides whether the differential voltage is equal to or more than a threshold. Here, when both the piezoelectric elements 1 and 2 are normal, the differential voltage is virtually zero, less than the threshold. However, when either the piezoelectric element 1 or the piezoelectric element 2 is faulty, the equilibrium of the bridge circuit is lost and the differential voltage increases to a level equal to or more than the threshold.

In consequence, when the differential voltage is less than the threshold, the decision circuit 5 decides that neither the piezoelectric elements 1 nor 2 is faulty. When the differential voltage is equal to or more than the threshold, the decision circuit 5 decides that the piezoelectric element 1 or piezoelectric element 2 is faulty.

As above, the inkjet head inspection device detects a differential voltage between the symmetric centers of the parallel circuits in which two circuit paths, each including each piezoelectric element, are disposed in parallel, and, when the differential voltage is found to be equal to or more than the threshold, it can detect that one of the piezoelectric elements is faulty, thus detecting the ink jet malfunction of the nozzle corresponding to the faulty piezoelectric element.

The inkjet head inspection device according to the first embodiment of the present invention is not limited to the configuration shown in FIG. 1 and may be configured as will be described below. Circuits corresponding to those in the circuitry of FIG. 1 are assigned the same reference numerals and their explanation in detail is not repeated.

Figure 3:
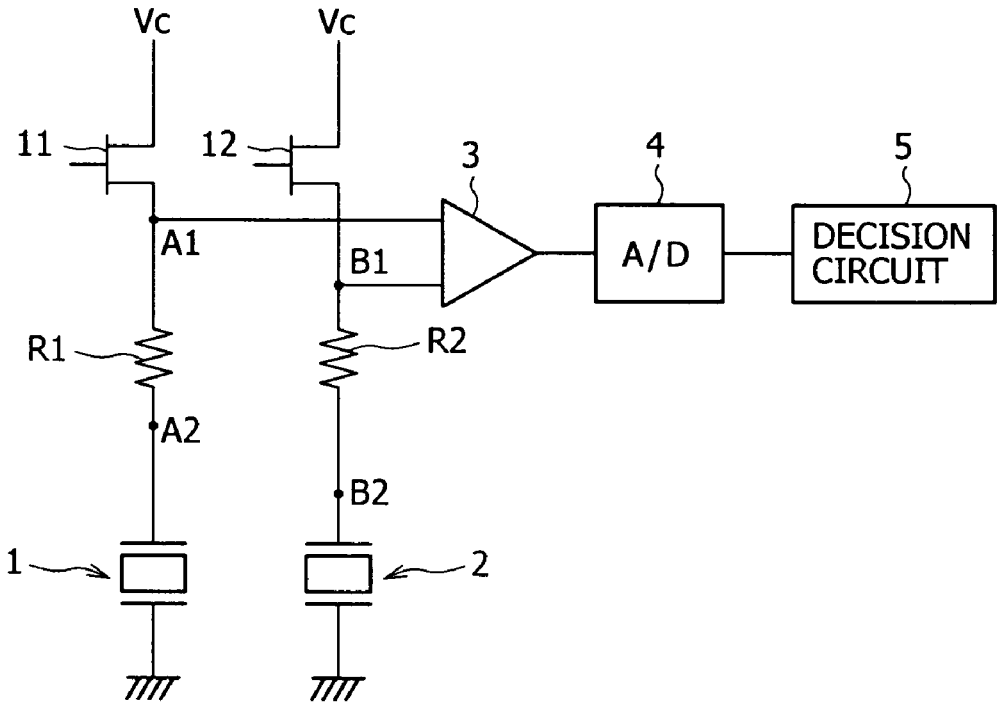
FIG. 3 shows another circuitry of the inkjet head inspection device.

FIG. 3 shows another circuitry 1 of the inkjet head inspection device.

One electrode of the piezoelectric element 1 is grounded and the other electrode thereof is connected via the resistor R1 to the source of a Field Effect Transistor (FET) 11. To the drain of the FET 11, the drive voltage Vc is applied. One electrode of the piezoelectric element 2 is grounded and the other electrode thereof is connected via the resistor R2 to the source of an FET 12. To the drain of the FET 12, the drive voltage Vc is applied.

One input terminal of the differential amplifier circuit 3 is connected to a point A1 where the resistor R1 and the FET 11 are connected. The other input terminal of the differential amplifier circuit 3 is connected to a point B1 where the resistor R2 and the FET 12 are connected The ON-resistance of the FET 11 is equal to that of the FET 12. Thus, the points A1 and B1 correspond to the symmetric centers of parallel circuits in which one series circuit of the FET 11, resistor R1, and piezoelectric element 1 and the other series circuit of the FET 12, resistor R2, and piezoelectric element 2 are connected in parallel.

When both the FETs 11 and 12 turn ON, the differential amplifier circuit 3 detects a differential voltage between the points A1 and B1 and supplies this differential voltage via the A/D converter 4 to the decision circuit 5.

In consequence, when the differential voltage is less than the threshold, the decision circuit 5 can decide that neither the piezoelectric elements 1 nor 2 is faulty. When the differential voltage is equal to or more than the threshold, the decision circuit 5 can decide that the piezoelectric element 1 or the piezoelectric element 2 is faulty.

The differential amplifier circuit 3 may detect a differential voltage between a point A2 where the resistor R1 and the piezoelectric element 1 are connected and a point B2 where the resistor R2 and the piezoelectric element 2 are connected. By continuously changing the two FETs to turn ON, the nozzles to be inspected may be changed continuously.

Figure 4:
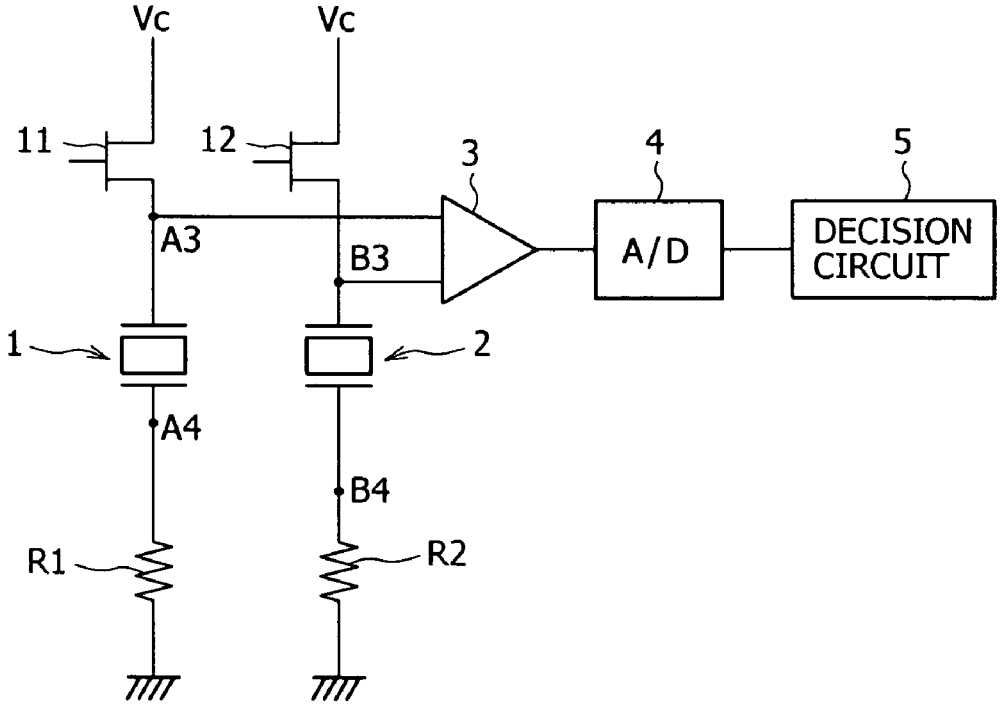
FIG. 4 shows yet another circuitry of the inkjet head inspection device.

FIG. 4 shows another circuitry 2 of the inkjet head inspection device. This inkjet head inspection device has the resistor R1 and the piezoelectric element 1 in positions inverted from those in the circuit shown in FIG. 3 and the resistor R2 and the piezoelectric element 2 in positions inverted from those in the circuit shown in FIG. 3

Points A3 and B3 correspond to the symmetric centers of parallel circuits in which one series circuit of the FET 11, piezoelectric element 1, and resistor R1 and the other series circuit of the FET 12, piezoelectric element 2, and resistor R2 are connected in parallel.

In consequence, when the differential voltage is less than the threshold, the decision circuit 5 can decide that neither the piezoelectric elements 1 nor 2 is faulty. When the differential voltage is equal to or more than the threshold, the decision circuit 5 can decide that the piezoelectric element 1 or the piezoelectric element 2 is faulty.

The differential amplifier circuit 3 may detect a differential voltage between a point A4 where the resistor R1 and the piezoelectric element 1 are connected and a point B4 where the resistor R2 and the piezoelectric element 2 are connected.

Figure 5:
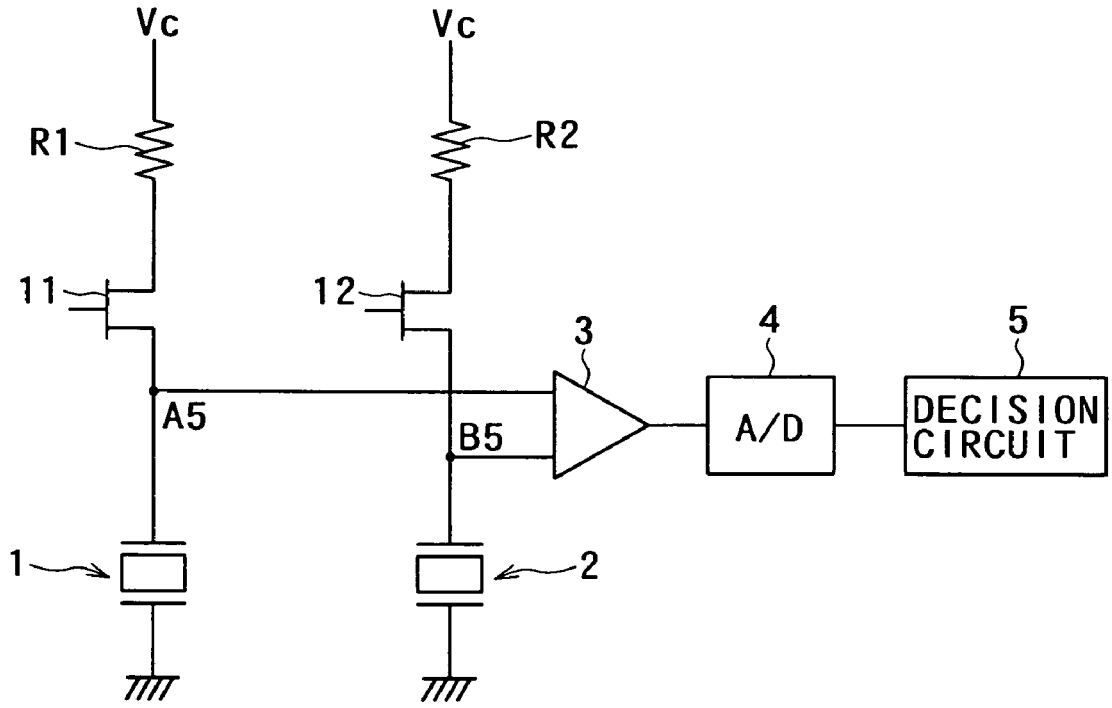
FIG. 5 shows yet another circuitry of the inkjet head inspection device.

FIG. 5 shows another circuitry 3 of the inkjet head inspection device.

One electrode of the piezoelectric element 1 is grounded and the other electrode thereof is connected to the source of the FET 11. To the drain of the FET 11, the drive voltage Vc is applied via the resistor R1. One electrode of the piezoelectric element 2 is grounded and the other electrode thereof is connected to the source of the FET 12. To the drain of the FET 12, the drive voltage Vc is applied via the resistor R2.

One input terminal of the differential amplifier circuit 3 is connected to a point A5 where the FET 11 and the piezoelectric element 1 are connected. The other input terminal of the differential amplifier circuit 3 is connected to a point B5 where the FET 12 and the piezoelectric element 2 are connected. The points A5 and B5 correspond to the symmetric centers of parallel circuits in which one series circuit of the resistor R1, FET 11, and piezoelectric element 1 and the other series circuit of the resistor R2, FET 12, and piezoelectric element 2 are connected in parallel.

When both the FETs 11 and 12 turn ON, the differential amplifier circuit 3 detects a differential voltage between the points A5 and B5 and supplies this differential voltage via the A/D converter 4 to the decision circuit 5.

In consequence, when the differential voltage is less than the threshold, the decision circuit 5 can decide that neither the piezoelectric elements 1 nor 2 is faulty. When the differential voltage is equal to or more than the threshold, the decision circuit 5 can decide that the piezoelectric element 1 or the piezoelectric element 2 is faulty.

Normally, the gate voltages of the FETs 11 and 12 are used in a saturation region. However, if the gate voltages of the FETs 11 and 12 are used in an unsaturated region, the resistors R1 and R2 shown in FIG. 5 can be dispensed with.

Figure 6:
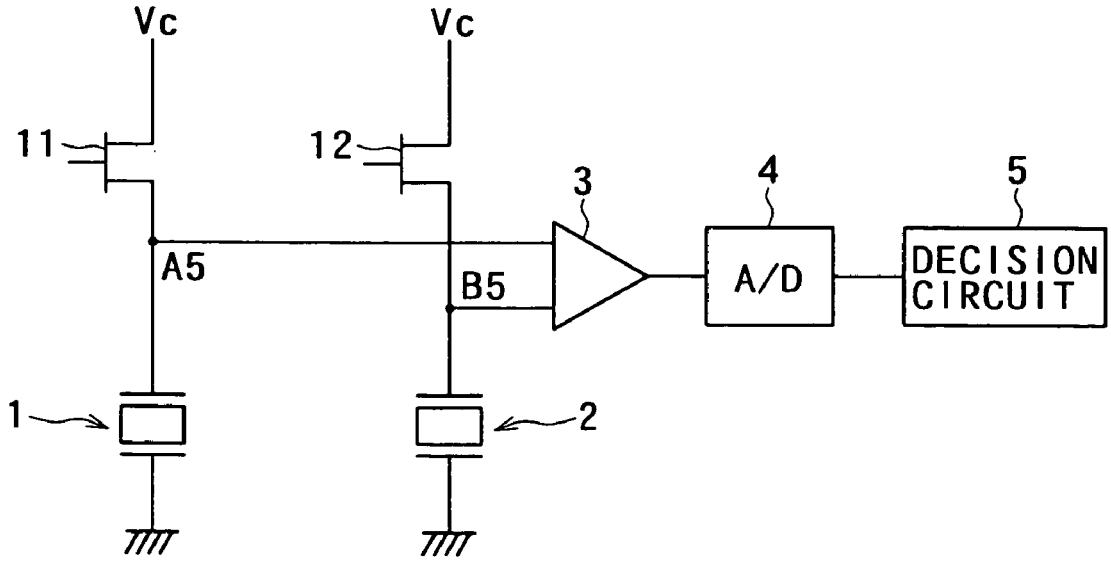
FIG. 6 shows yet another circuitry of the inkjet head inspection device.

FIG. 6 shows another circuitry 4 of the inkjet head inspection device. As above, when the gate voltages of the FETs 11 and 12 are used in an unsaturated region, the resistors R1 and R2 are dispensed with, whereas the same effect as if the resistors existed is obtained; therefore, the circuitry shown in FIG. 6 can be configured.

Second Embodiment

Next, a second embodiment of the present invention is described. Circuits corresponding to those in the first embodiment are assigned the same reference numerals and their explanation in detail is not repeated.

Figure 7:
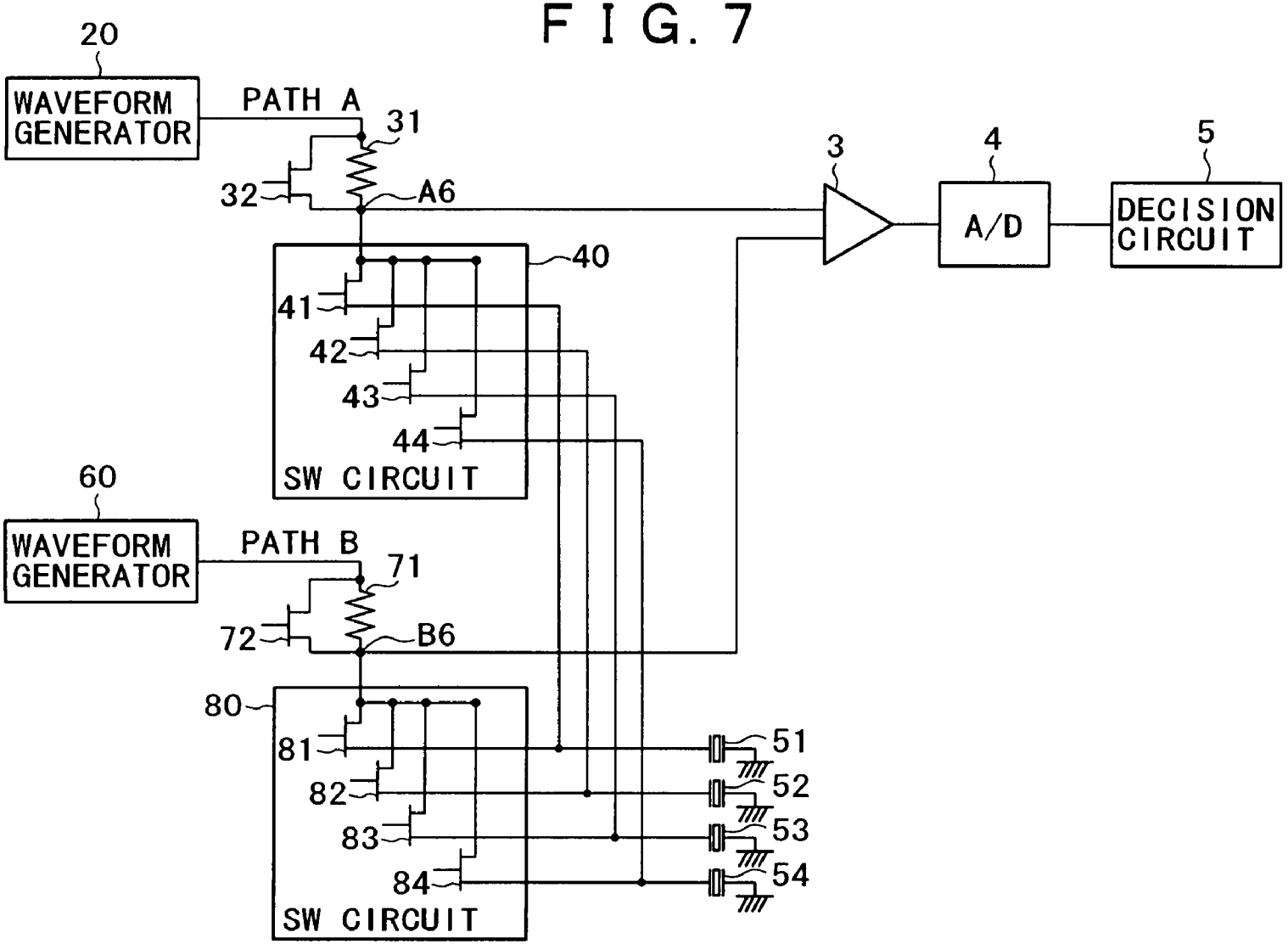
FIG. 7 shows a circuitry of an inkjet head inspection device according to a second embodiment of the present invention.

FIG. 7 shows a circuitry of an inkjet head inspection device according to the second embodiment of the present invention. This inkjet head inspection device selects and inspects any pair of four piezoelectric elements 51 to 54.

The inkjet head inspection device is equipped with waveform generators 20, 60 which generate drive voltage waveforms, switch circuits 40, 80 which select piezoelectric elements to be inspected and applied with the drive voltage, a differential amplifier circuit 3 which amplifies and outputs a differential voltage between one-end electrodes of any pair of the piezoelectric elements 51 to 54, an A/D converter 4 which performs analog-to-digital conversion of the differential voltage, and a decision circuit 5 which decides whether an ink jet malfunction occurs in nozzles to be inspected, based on the differential voltage converted to a digital signal.

The waveform generators 20 and 60 generate drive voltages with different frequencies for driving the inkjet head when the inkjet printer prints, and generate drive voltages with the same frequency when the inkjet head is inspected.

On end of a resistor 31 is connected to the waveform generator 20 and the drain of an FET 32. The other end of the resistor 31 is connected to the source of the FET 32 and the drains of FETs 41, 42, 43, 44 placed in the switch circuit 40. On end of a resistor 71 is connected to the waveform generator 60 and the drain of an FET 72. The other end of the resistor 71 is connected to the source of the FET 72 and the drains of FETs 81, 82, 83, 84 placed in the switch circuit 80.

The FET 32 and the FET 72 turn ON when the inkjet printer prints, and short-circuit the resistor 31 and the resistor 71 respectively to avoid voltage drop. The FET 32 and the FET 72 turn OFF when the inkjet head is inspected.

One electrode of the piezoelectric element 51 is connected to the sources of the FET 41 and FET 81 and the other electrode thereof is grounded. One electrode of the piezoelectric element 52 is connected to the sources of the FET 42 and FET 82 and the other electrode thereof is grounded. One electrode of the piezoelectric element 53 is connected to the sources of the FET 43 and FET 83 and the other electrode thereof is grounded. One electrode of the piezoelectric element 54 is connected to the sources of the FET 44 and FET 84 and the other electrode thereof is grounded.

Through this arrangement, each of the switch circuits 40 and 80 can select any of the piezoelectric elements 51 to 54 and apply the drive voltage to it. However, the switch circuits 40 and 80 will not select the same piezoelectric element when the inkjet head is inspected.

One input terminal of the differential amplifier circuit 3 is connected to the source (a point A6) of the FET 32 and the other input terminal thereof is connected to the source (a point B6) of the FET 72. The output terminal of the differential amplifier circuit 3 is connected via the A/D converter 4 to the decision circuit 5.

The inkjet head inspection device configured as above compares and inspects any pair of the piezoelectric elements 51 to 54. For example, when the inkjet head inspection device compares and inspects the piezoelectric elements 51 and 52, the FET 41 in the switch circuit 40 and the FET 82 in the switch circuit 82 are turned ON.

Figure 8:
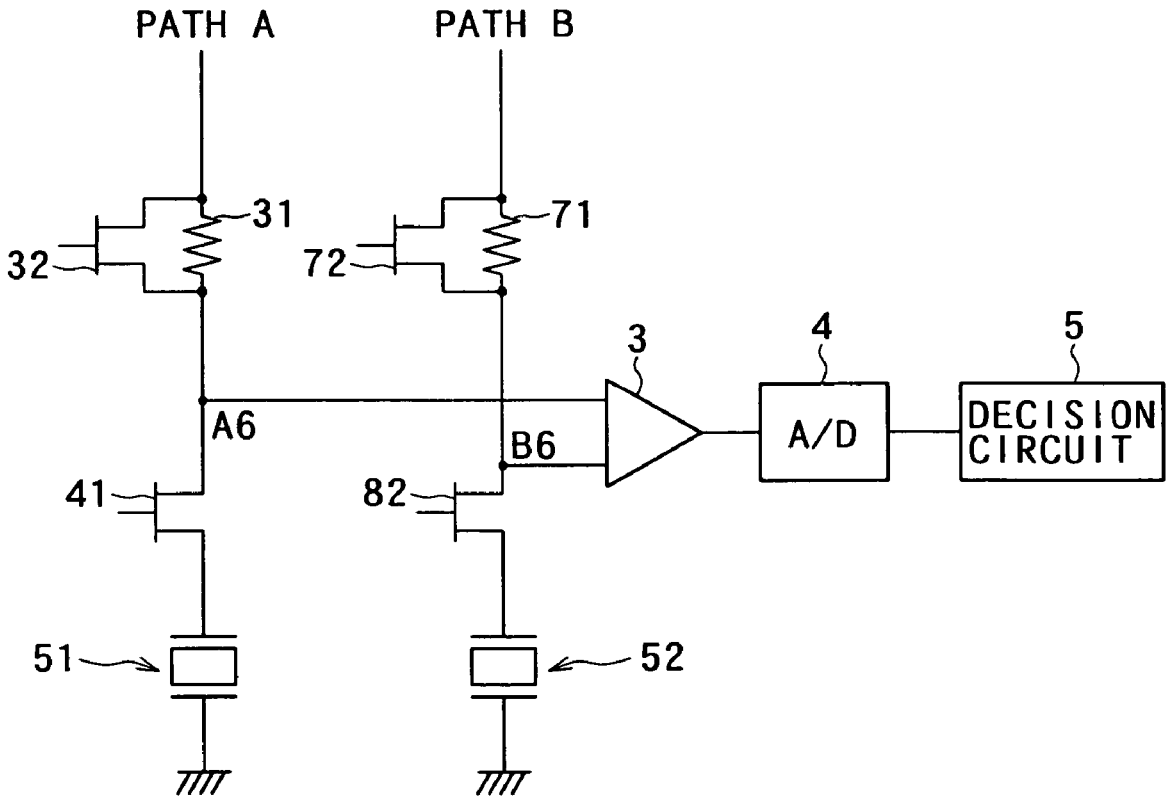
FIG. 8 shows the circuitry of an elementary part of the inkjet head inspection device.

FIG. 8 shows the circuitry of an elementary part of the inkjet head inspection device, with the FET 41 and FET 82 being ON. As shown in FIG. 8, a path A connected to the waveform generator 20 is the one in which the resistor 31, FET 41, and piezoelectric element 51 are connected in series. A path B connected to the waveform generator 60 is the one in which the resistor 71, FET 82, and piezoelectric element 52 are connected in series. Therefore, the points A6 and B6 correspond to symmetric centers of the paths A and B.

When the FET 32 and FET 72 turn OFF, the drive voltages with the same frequency are applied to the piezoelectric elements 51 and 52. The differential amplifier circuit 3 outputs a differential voltage between the points A6 and B6 and supplies this differential voltage via the A/D converter 4 to the decision circuit 5. In consequence, when the different voltage is less than the threshold, the decision circuit 5 can decide that neither the piezoelectric elements 51 nor 52 is faulty. When the differential voltage is equal to or more than the threshold, the decision circuit 5 can decide that the piezoelectric element 51 or piezoelectric element 52 is faulty.

As above, the inkjet head inspection device according to the second embodiment of the present invention detects a differential voltage between the central points of the paths A and B, each including each piezoelectric element, and, when the differential voltage is found to be equal to or more than the threshold, it can detect that either piezoelectric element is faulty, thus detecting the ink jet malfunction of the nozzle corresponding to the faulty piezoelectric element.

It will be appreciated that the present invention is not limited to the illustrative embodiments described hereinbefore and may be embodied in other modified forms without departing from its spirit or characteristics as defined in the appended claims and their equivalents. For instance, while the FETs included in the first and second embodiments are taken as examples of ON/OFF switching elements, transistors may replace the FETs and such elements are not so limited.

While the inkjet head inspection devices of the first and second embodiments inspect whether an ink jet malfunction occurs by comparing two nozzles, the inspection may be performed by comparing plural nozzles in sequence and detecting a malfunctioned nozzle by a majority decision rule.

While, in the first and second embodiments, the differential amplifier circuit 3 supplies the differential voltage directly to the A/D converter 4, the differential voltage may be level shifted or rectified and supplied to the A/D converter 4.

If the inputs to the differential amplifier circuit 3 are the same, the decision circuit 5 may decide that both the piezoelectric elements are normal or that both the piezoelectric elements are faulty. Instead of the A/D converter 4 and the decision circuit 5, an analog comparator may be used for decision.

As described above, according to an embodiment of the invention, there is provided an inkjet head inspection device that inspects an inkjet head including plural nozzles that eject ink droplets, plural ink reservoirs that contain the ink to be ejected from the plural nozzles, and plural piezoelectric elements that exert pressure on the ink reservoirs to force the ink droplets out of the nozzles, the inkjet head inspection device including a differential amplifier section that amplifies a differential voltage between respective ground-side electrodes or opposite-side electrodes of the piezoelectric elements corresponding to two nozzles to be inspected, when a drive voltage application section applies a drive voltage to each of the piezoelectric elements and a decision section that decides whether an ink jet malfunction occurs in the two nozzles to be inspected, based on the differential voltage furnished from the differential amplifier section.

When the drive voltage is applied to the piezoelectric elements of the inkjet head, the piezoelectric elements vibrate and this vibration induces the ink contained in the ink reservoirs to be ejected from the nozzles.

The differential amplifier section is connected to the ground-side electrodes or opposite-side electrodes of the piezoelectric elements corresponding to two nozzles to be inspected and amplifies and outputs a differential voltage between the electrodes. Here, the piezoelectric elements have identical impedance characteristics. If the piezoelectric elements themselves are not faulty and they are free of a connection fault, the differential voltage is zero or nearly zero. However, if either piezoelectric element itself is faulty or connection is faulty, the differential voltage exceeds zero. If either piezoelectric element itself is faulty or connection is faulty, an ink jet malfunction occurs in the nozzle corresponding to the faulty piezoelectric element.

Thus, the decision section can decide whether an ink jet malfunction occurs in the two nozzles to be inspected, based on the differential voltage furnished from the differential amplifier section.

As above, the inkjet head inspection device according to an embodiment of the present invention, in a simple structure, can detect an ink jet malfunction in an inkjet head by amplifying a differential voltage between the respective ground-side electrodes or opposite-side electrodes of the piezoelectric elements corresponding to two nozzles to be inspected and deciding whether an ink jet malfunction occurs in the two nozzles to be inspected, based on the differential voltage furnished.

According to another embodiment of the invention, in the inkjet head inspection device, a first circuit path in which the drive voltage application section and a piezoelectric element for one nozzle to be inspected are connected in series and a second circuit path in which the drive voltage application section and a piezoelectric element for another nozzle to be inspected are connected in series may be disposed in parallel, and the differential amplifier section may amplify a differential voltage between symmetrical points of the first and second circuit paths.

According to another embodiment of the invention, the differential amplifier section may amplify the differential voltage between equilibrium points of a bridge circuit constituted by the first and second circuit paths. In this manner, it can be inspected whether an ink jet malfunction occurs by detecting whether the equilibrium of the bridge circuit is lost.

According to another embodiment of the invention, the inkjet head inspection device may further include plural switching elements, each provided for each of the piezoelectric elements and connected in series to the drive voltage application section and each of the piezoelectric elements, and among the plural switching elements, switching elements corresponding to the nozzles to be inspected may turn ON. In this manner, by continuously changing the switching elements to turn ON, the nozzles to be inspected can be changed continuously.

According to another embodiment of the invention, in the inkjet head inspection device, field effect transistors may be used as the switching elements and the gate voltages of the field effect transistors may be set in an unsaturated region. This manner can reduce the number of resistors in the circuitry.

The inkjet head inspection device according to an embodiment of the present invention, in a simple structure, can reliably detect an ink jet malfunction in an inkjet head by amplifying a differential voltage between the respective ground-side electrodes or opposite-side electrodes of the piezoelectric elements corresponding to two nozzles to be inspected and deciding whether an ink jet malfunction occurs in the two nozzles to be inspected, based on the differential voltage furnished.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2004-278148 filed on Sep. 24, 2004 including specification, claims, drawings and abstract is incorporated herein by reference in its entirety.

What is claimed is:

1. An inkjet head inspection device that inspects an inkjet head comprising a plurality of nozzles that eject ink droplets, a plurality of ink reservoirs that contain the ink to be ejected from the plurality of nozzles, and a plurality of piezoelectric elements that exert pressure on the ink reservoirs to force the ink droplets out of the nozzles, the inkjet head inspection device comprising: a differential amplifier section that amplifies a differential voltage between respective ground-side electrodes or opposite-side electrodes of the piezoelectric elements corresponding to two nozzles to be inspected, when a drive voltage application section applies a drive voltage to each of the piezoelectric elements; and a decision section that decides whether an ink jet malfunction occurs in the two nozzles to be inspected, based on the differential voltage furnished from the differential amplifier section.

2. The inkjet head inspection device according to claim 1, wherein a first circuit path in which the drive voltage application section and a piezoelectric element for one nozzle to be inspected are connected in series and a second circuit path in which the drive voltage application section and a piezoelectric element for another nozzle to be inspected are connected in series are disposed in parallel, and the differential amplifier section amplifies a differential voltage between symmetrical points of the first and second circuit paths.

3. The inkjet head inspection device according to claim 2, wherein the differential amplifier section amplifies the differential voltage between equilibrium points of a bridge circuit constituted by the first and second circuit paths.

4. The inkjet head inspection device according to claim 1, further comprising a plurality of switching elements, each provided for each of the piezoelectric elements and connected in series to the drive voltage application section and each of the piezoelectric elements, wherein, among the plurality of switching elements, switching elements corresponding to the nozzles to be inspected turn ON.

5. The inkjet head inspection device according to claim 4, wherein the switching elements are field effect transistors and gate voltages of the field effect transistors are set in an unsaturated region.

* * * * *